United States Patent [19]

Haessler et al.

[11] Patent Number: 4,780,582

[45] **Date of Patent: * Oct. 25, 1988**

[54] USE OF A FUSION MATERIAL OF COPPER AND CHROME AS THE CONTACT MATERIAL FOR VACUUM CONTACTORS

[75] Inventors: Heinrich Haessler, Wendelstein; Reiner Müeller, Kleinsendelbach; Horst Kippenberg, Herzogenaurach; Wilfried Kuhl, Wendelstein; Joachim Grosse, Erlangen, all of Fed. Rep. of Germany

[73] Assignee: Siemens Aktiengesellschaft, Berlin and Munich, Fed. Rep. of Germany

[ * ] Notice: The portion of the term of this patent subsequent to Sep. 22, 2004 has been disclaimed.

[21] Appl. No.: 13,224

[22] Filed: Feb. 5, 1987

Related U.S. Application Data

[63] Continuation of Ser. No. 760,408, Jul. 30, 1985, abandoned.

[30] Foreign Application Priority Data

Jul. 30, 1984 [DE] Fed. Rep. of Germany ..... 3428114

[51] Int. Cl.[4] ..... H01H 1/02

[52] U.S. Cl. ..... 200/266

[58] Field of Search ..... 200/263, 265, 266

[56] References Cited

U.S. PATENT DOCUMENTS

| | | | |
|---|---|---|---|
| 4,048,117 | 9/1977 | Emmerich | 252/513 |
| 4,537,745 | 8/1985 | Hässler et al. | 420/590 |
| 4,553,003 | 11/1985 | Cherry | 200/144 B |
| 4,554,425 | 11/1985 | Kashiwagi et al. | 200/265 |
| 4,695,687 | 9/1987 | Grosse et al. | 200/144 B |

FOREIGN PATENT DOCUMENTS

| | | |
|---|---|---|
| 3303170 | 8/1984 | Fed. Rep. of Germany . |
| 2066298 | 7/1981 | United Kingdom . |
| 2123852 | 2/1984 | United Kingdom . |

*Primary Examiner*—Renee S. Luebke

*Attorney, Agent, or Firm*—James G. Morrow

[57] ABSTRACT

This invention relates to a new use of a fused material of copper and chrome as a contact material for use in vacuum contactors. In addition, the invention relates also to the contact material itself and to the method of its fabrication, as well as for special contact arrangements in the vacuum contactors.

The invention shows a whole new, unsuspected range of application for the above fused materials. Up to now, contactors normally used material based on tungsten and copper which were first sintered and then immersed. It has now been experimentally shown that fused materials of copper and chrome, particularly after being reshaped, are very well suited as a contact material for vacuum contactors. Furthermore, in contact pieces of said fused material, methods are provided for additional additives to be precisely inserted by localized alloying, diffusion, or related techniques.

4 Claims, 1 Drawing Sheet

USE OF A FUSION MATERIAL OF COPPER AND CHROME AS THE CONTACT MATERIAL FOR VACUUM CONTACTORS

CROSS-REFERENCE TO RELATED APPLICATION

This is a continuation of Ser. No. 760,408 filed July 30, 1985, now abandoned.

BACKGROUND OF THE INVENTION

The invention relates to a new use of a fused material of the metals copper and chrome as contact material for use in vacuum contactor circuit interrupters. More particularly, the invention relates to the contact material itself, the process for its manufacture, the contact pieces made of this material, the process for the contact piece manufacture, and special contact arrangements in vacuum contactors.

Materials made of copper and chrome are known from state-of-the-art engineering. To the extent that they are used as contact materials, they are normally used for vacuum circuit breakers. In such circuit breakers, for example medium-voltage circuit breakers, the key requirement is to be able to switch both high voltages in the kilo-volt range and high currents in the kilo-ampere range. Since the number of switching cycles in circuit breakers is relatively low, their service life can be designed to be on the order of 10,000 switching operations.

Aside from circuit breakers, vacuum contactors are also classified among vacuum switchgear in contrast to vacuum breakers. These are characterized by a very high service life, wherein the desired service life at nominal current is equal to 1,000,000 or more switching cycles.

It is desirable for the materials used for contact components of vacuum contactors, due to this long service life requirement, to meet particularly high standards, especially in terms of their erosion characteristics. During their entire service life, they must be able to reliably handle operating currents of up to approximately 5 kA, and they must also exhibit favorable welding characteristics. A low welding force is desired, so that the opening of the contact pieces is assured even after transient short-circuit currents. It is also desirable to have a material in which the mean value of the chopping current falls significantly below 5 A.

Existing vacuum contactor systems have utilized a compound material based on tungsten and copper as the contact material for vacuum contactors. Therein the tungsten (W) is utilized as the refractory and particularly erosion-resistant component, while the copper (Cu) prevents any overheating of the switching surface, since, it is electrically and thermally a highly conductive material. Since the WCu materials are produced by sintering a matrix of the refractory components and then impregnating the matrix with the low temperature components, the effect of matrix cooling by the material with the lower boiling point can be used against overheating. To reduce the welding force and chopping current, usually additional metallic components, e.g., antimony or tellurium, are added.

The known materials are of tungsten/copper are presently being used successfully for vacuum contactors in the high voltage range, with switching currents up to approximately 3 kA. Due to the increased design requirements regarding switching currents and switching operations, particularly in the low voltage engineering range up to 1 kV, improvements in the contact materials are required. However, tungsten/copper materials can meet these only to a limited extent. The reason lies in the special erosion mechanism of this system. When under arcing loads, due to the extremely high temperatures at the cathode base points of the arc, copper and tungsten are melted and evaporated simultaneously. However, in the perimeter regions of the arc base points, with their lower heating loads the copper tends to be evaporated to a higher degree from the matrix. After the conclusion of numerous nominal current switchings or after a series of high current switching cycles, local copper shortages within the structure may result, thereby generating tungsten-enriched points on the switching surface. A typical structure of a tungsten/copper contact surface which reflects the loading effects imposed by numerous switching cycles therefore includes torn-up and scaly areas.

For dielectric and thermal reasons, these surface structures naturally restrict the switching characteristics and thus the service life of the contact material. Up to now, by the selection of suitable concentration ratios and specific powder particle sizes, the contact material was optimized to the specifically required characteristics. But particularly in the area of low voltage, there is a need to find other contact materials with better erosion/evaporation characteristics.

Investigation of the copper-chrome fused alloys manufactured for vacuum circuit breakers according to the process outlined in U.S. Pat. No. 4,537,745 which is hereby incorporated by reference, has revealed that they are ideally suited as contact materials in vacuum contactors in low and high voltage applications.

An analysis of the metallurgical and particularly thermodynamic conditions of the contacts was made. The desired material had to be a compound material in order to be able to exploit the best characteristics of this contact material classification. It was recognized that the already-described unfavorable erosion/evaporation pattern of tungsten/copper was based primarily on the widely varying vapor pressures of the two metals utilized heretofore. The basis of the invention then was the recognition that a metal combination had to be found whose components, despite otherwise different characteristics should have, as far as possible, similar vapor pressures. Such a combination is specifically provided by a material based on chrome and copper.

As already mentioned, a material based on chrome and copper is already known as a contact material. It was, however, heretofore used advantageously as a contactor piece in high-current, voltage-bearing medium-voltage vacuum circuit breakers. For this operating range the favorable even erosion/evaporation pattern and the resulting dielectric strength were utilized. As in this framework no high numbers of switching operations are required, the substantial erosion/evaporation rate of chrome/copper with high switch-off currents could easily be tolerated.

Particularly due to the suspected erosion/evaporation rate in vacuum circuit breakers, the scientific community was generally considered chrome/copper materials unsuitable for vacuum contactors. The differentiation of the application range of known contact materials is specified in the monograph by A. Keil and others, "Electrical Contacts and Their Materials," Springer Publishing House, 1984, Chapter 4.3, "Switchgear,", particularly table 4.7, page 359.

With this invention, however, it was surprisingly found that a material based on chrome/copper could also be used for vacuum contactors. Thus the prejudice prevailing in the scientific community will be overcome!

Against all expectations, the erosion/evaporation resistance of this material could be demonstrated particularly under contactor conditions, wherein the material easily retained its short-circuit current switchoff capability after experiencing the required switching operations of greater than $10^6$ at nominal current. For example, measurements with 600 Å nominal current at approximately $10^6$ switching cycles found a change of erosion/evaporation elevation consumption of less than 1 mm per contact piece. At double the nominal current with switching operations of $3.10^5$, an erosion/evaporation consumption of less than 1 mm per contact piece was similarly found.

An explanation of the above-specified unexpected consumption behavior is probably due to the different arcing formations in vacuum contactors, in contrast to those of circuit breakers. In particular, the similar vaporization behavior due to largely similar vapor pressure curves of both components represented the main basis for this result.

Tests confirmed that within the framework of this discovery a fused material is suitable for the above-specified use with a composition in components of approximately 25–60%. It was found that the contact material already had satisfactory characteristics after fabrication using fusing processes, preferrably by arc fusion. This material already demonstrated a linear alignment of the Cr dendrites. Thus, so that this linear alignment of the Cr dendrites runs vertically to the switching surface of the contact pieces, the fused material is preferrably reshaped so that its structural alignment is perpendicular to the switching surface. This forming process is best handled by continuous extrusion molding with a greater than 60% reshaping degree.

It was found that the requirements of the material, such as particularly low welding force and low breakdown currents, are generally met by the chrome/copper base material. In special cases, however, the require characteristics can be improved by special additives of tellurium, antimony, bismuth and/or tin. To introduce said additives, various procedures, e.g., smelting, diffusing, or inserting in depressions, can be utilized.

It was also found that vacuum contactors could have an unpaired contact arrangement with contact pieces of fusion materials with different additives, without losing their advantageous characteristics during switching operations.

It is an object of this invention to discover a contact material for use in vacuum contactors which has as good or better switching characteristics as existing tungsten/copper contact materials in their initial condition, and due to better erosion/evaporation characteristics, have a longer and more reliable service life, while retaining the same type of short-circuit current resistance. It is a further object of this invention to discover such a material which also has a low welding force. It is also an object of this invention to discover a method for making the contact material with the above-mentioned switching characteristics. It is also an object of this invention to provide a method for makng the contacts for use in vacuum contactors from the material with the above-mentioned characteristics.

SUMMARY OF THE INVENTION

Briefly stated, in accordance with one aspect of the invention, the foregoing objects are achieved by providing the use of a fused copper and chrome alloy contact material in vacuum contactors.

In a second aspect of the invention, the objects are achieved by providing an electrical contact material for use in vacuum contactors comprised of a fused composite of copper and chrome, having a chrome content of 25 to 60 percent by weight.

A third aspect of the invention is a method for fabricating an electrical contact material comprised of a copper and chrome composite having a chrome content of between 25 to 60 percent by weight, comprising the steps of initially arc fusing the copper and chrome composite and then forming a fused block of contact material therefrom.

The method of fabricating the contact piece itself for vacuum contactors is a fourth aspect of the invention. This aspect is accomplished by arc fushing a copper and chrome composite having a chrome content in the range of 25 to 60 percent by weight, forming the arc fused material into a fused block of contact material, cutting the fused block into discs, and punching out contact pieces from each disc.

Another method of fabricating the contact piece for vacuum contactors according to the invention is a fifth aspect of the invention. This aspect is accomplished by fabricating a fused block of copper and chrome having a chrome content in the range of 25 to 60 percent by weight, adding one or more metals from the group of tellurium, antimony, bismuth and tin for reducing the welding force of the material, forming a fused block of contact material of the mixture, and reshaping the fused block producing a working stock with a grain structure alignment of chrome dendrites in a preferred direction. The working stock is then cut into discs in a direction normal to the preferred direction of the grain structure. Contact pieces having a switching surface perpendicular to the preferred grain structure are formed from the cut discs.

A final aspect of the invention is the ability to have an arrangement of two differently composed contact pieces within a vacuum contactor comprising a first contact piece fabricated from a fused material obtained by fusing a copper and chrome composite having a chrome content of 25 to 60 percent by weight and a second contact piece fabricated from a fused material obtained by fusing a copper and chrome composite having a chrome content of 25 to 60 percent by weight one or more metals from the group of tellurium, antimony, bismuth, and tin are added for reducing the welding force of the contact piece.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

The invention can best be understood by the following examples of preparing the material and the electrical contact pieces.

Example 1

A fusible block is to be fabricated utilizing the arc-fusing procedure of a powdery mix with a composition of 60% copper (Cu) and 40% chrome (Cr). In this example, the blank is to have the dimensions of 80 mm diameter and 400 mm length. To this, the powder mix of the relevant composition will be pressed isostatically at a pressure of 3,000 bar and then burned subsequently in a vacuum at temperatures just below the copper melting point, or in the case of a liquid phase formation, approximately 50 degrees Centigrade above the copper smelting point. The sintered blank is then inserted as a melt-down electrode in an arc-smelting oven and resmelted with helium functioning as the protective gas. To attain the required high energy density, the arcing current at the dimension specified has to be a minimum of 1,000 Å. The melted electrode material then hardens in a water-cooled copper mold.

In place of the ratio of 60% copper and 40% chrome, other compositions ranging between 25–60% chrome can also be selected.

From this fused block produced by arc fusion, the stock (semi-finished product) for contact pieces is fabricated by continuous extrusion melting. In that process, reshaping degrees of greater than 60% are utilized, for example, 78%. Thus, after initially making the fused block, in this case from a blank diameter of 75 mm, a rod diameter of 35 mm is formed as a working stock. This working stock has a structural alignment in which particularly the chrome dendrites contained in the material are arranged in line with a preferred orientation. If now from this rod, after possible further machining of the surface to remove impurities, discs of for instance 5 mm width are cut off as contact pieces, then of necessity the switching surface would be vertical to the prevailing structural alignment.

Example 2

Following fusing procedures as elaborated in Example 1, the fused block of 80 mm diameter is cut into discs of 5 mm thickness. From these discs then three contact pieces of 35 mm diameter can be stamped out.

The contact pieces fabricated in accordance with Example 1 or 2 can be installed in the switching tubes of vacuum contactors. However, as will be shown in Example 3 through 5 in conjunction with the illustrations, special additive components can be introduced into the contact pieces before that takes place.

Example 3

Contact pieces are to be fabricated with a composition of 58.5% copper, 38.5 chrome, and 3% tellurium. For that purpose, initially in accordance with Example 1, contact pieces of copper and chrome are fabricated by arc-fusion and subsequent reshaping, selecting in this case a composition of 60% copper and 40% chrome. Tellurium is then to be alloyed into the contact discs produced after reshaping and cutting.

Figure 1A:
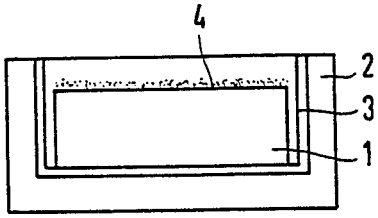
FIGS. 1 through 4 illustrate diagrammatically four of the possibilities for introducing specific additives in the material for the contact pieces.
Figure 1B:
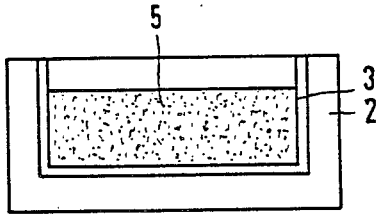

This latter process is described clearly in reference to FIGS. 1*a* and 1*b*. A CuCr disc 1 is mounted in a suitably designed graphite dish 2 inserting a graphite paper 3 between the surfaces. On the upper surface of the CuCr disc 1, more than enough tellurium powder 4 is placed. Then dish 2 is heated to 1150 degrees Centigrade and held approximately 1 hour at that level under inert gas. The result is a contact piece 5 of the required composition with the tellurium supplies being alloyed in the material at the desired quantity.

The tellurum content can range from 0.1 to 10% in accordance with the requirements for welding force and breakdown current.

In the same way as described for tellurium, antimony, bismuth or tin or combinations of these metals can be alloyed into the contact pieces.

Example 4

In this example, contact pieces with a composition of 48.5% copper, 48.5% chrome and 3% antimony are to be fabricated. First, contact pieces with a composition of 50% copper and 50% chrome are again fabricated by arc fusion and susequent reshaping. After cutting the discs the antimony is introduced by diffusion; for that purpose, a depression is machined into the contact piece, wherein the antimony can be placed.

Figure 2A:
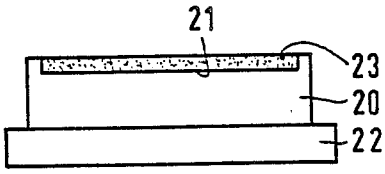
Figure 2B:
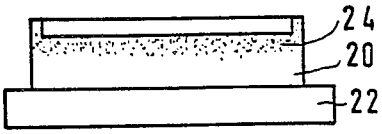

This latter process is shown in detail in FIGS. 2*a* and 2*b*. A copper-chrome contact piece 20 is designed with a depression 21, more or less shaped like a bowl. It is placed on an alumina dish 22. Into the depression of contact piece 20 antimony powder 23 is placed. After heating to approximately 1,000 degrees C. using inert gas and holding at that temperature for approximately 2 hours, a diffusion zone 24 forms with the above-specified concentration in the copper-chrome disc. The depth configuration as well as antimony concentration of the diffusion zone 24 can be controlled by the temperature holding time as well as the amount of antimony introduced.

Figure 3A:
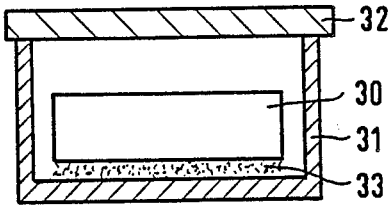
Figure 3B:
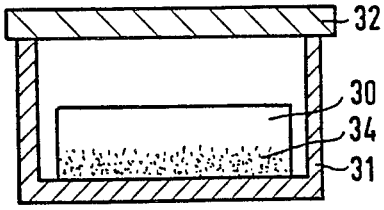

FIGS. 3*a* and 3*b* shows an alternative option. Here we have a copper-chrome disc 30 placed in an alumina dish 31 which is covered by a plate 32 of carbon. Between the base plate of the alumina dish 31 and the copper-chrome disc 30 a more than adequate amount of antimony powder 33 is available. After heating to approximately 1000 degrees C. a diffusion zone 34 develops starting from below after approximately two hours. The depth of the diffusion zone is defined in accordance with the expected consumption cycle.

In a similar fashion, tin or combinations of antimony, tellurium or tin can be introduced into the contact pieces in place of antimony.

Example 5

In this example, contact pieces with localized additives are to be fabricated: For that purpose initially according to the processes described in Examples 1 or 2, once again disc-shaped contact pieces with a composition of, for example, 50% copper and 50% chrome are fabricated. Depressions, for example as centralized bore holes in the form of several bores or even as a circular keyway, are machined into appropriate places in the upper surface of these contact discs. Into these depressions metals or alloys with melting points beneath the melting point of the copper-chromium eutectic alloy are placed in the form of either a granulate or other suitable form. The metals tellurium, antimony, or antimony telluride, bismuth telluride and tin telluride have proven to be particularly advantageous alloys for this process. Said additive components are then melted in these depressions.

Figure 4A:
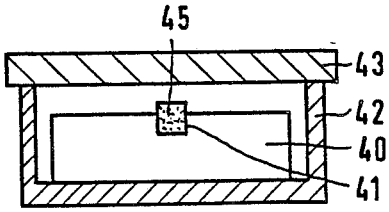
Figure 4B:
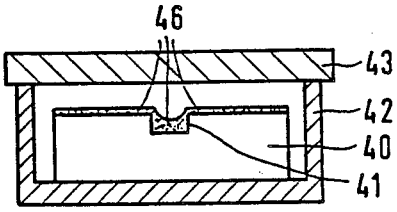

Said latter procedure is shown in FIGS. 4*a* and 4*b*. A copper chromium disc 40 with a central bore 41 is placed in a graphite dish 42 with cover 43. Into bore 41 the additive components are placed. After fusion, a thin layer 46 forms on the surface of contact piece 40, which then serves as the switching surface.

For use in vacuum contactors there is also the option of designing unpaired arrangements. It has been shown that a contact arrangement for vertical installation in the switching housing can advantageously be designed so that one contact piece has a composition of copper and chromium in accordance with the ratios defined in Examples 1 or 2, while the associated opposite contact piece is made of copper and chromium with specific additives. The latter contact piece can be designed in accordance with examples 3 through 5.

In the circuit contactor, especially particularly the upper contact piece can be made of a pure fused material with or without any deformation processes.

Thus, it will be understood that there has been disclosed a new and unexpected use of copper and chrome electrical contacts in long life vacuum contactors, and a method for fabrication of these contacts. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and scope of the invention.

What is claimed as new and desired to be secured by Letters Patent of the United States is:

1. A contact structure for a vacuum contactor having a major contact surface, the structure comprising:

a fused copper-chromium alloy contact material having a chromium content of 25% to 60% by weight and including chromium dendrites with a preferential orientation substantially normal to the major contact surface.

2. The structure of claim 1, wherein said contact material further comprises at least one additional metal chosen from a group consisting of tellurium, antimony, bismuth, and tin for reducing the contact welding force.

3. The structure of claim 2, wherein the total proportion of said additional metal is between 0.1% and 10% by weight.

4. The structure of claim 3, wherein said additional metal is concentrated in specific areas of the major surface.

* * * * *